US005213922A

United States Patent [19]

Matsuo et al.

[11] Patent Number: 5,213,922

[45] Date of Patent: May 25, 1993

[54] ELECTROSTATIC PRINTING METHOD

[75] Inventors: Makoto Matsuo; Hiroyuki Obata; Minoru Utsumi, all of Tokyo, Japan

[73] Assignee: Dai Nippon Printing Co., Ltd., Tokyo, Japan

[21] Appl. No.: 494,358

[22] Filed: Mar. 16, 1990

[30] Foreign Application Priority Data

Mar. 17, 1989 [JP] Japan ..... 1-65466

[51] Int. Cl.[5] ..... G03G 13/044

[52] U.S. Cl. ..... 430/48; 430/126; 355/217

[58] Field of Search ..... 430/48, 126; 355/217

[56] References Cited

U.S. PATENT DOCUMENTS

| | | | |
|---|---|---|---|
| 3,806,355 | 4/1974 | Kaufman | 430/48 |
| 3,924,945 | 12/1985 | Weigl | 430/48 |
| 4,023,895 | 5/1977 | O'Brien et al. | 430/48 |
| 4,195,927 | 4/1980 | Fotland et al. | 430/48 |

*Primary Examiner*—Marion E. McCamish
*Assistant Examiner*—Christopher D. RoDee
*Attorney, Agent, or Firm*—Nikaido, Marmelstein, Murray & Oram

[57] ABSTRACT

An electrostatic printing method, wherein a photosensitive member has a photoconductive layer formed on a support member with a conductive layer therebetween is placed face to face with a drum of electrostatic information recording medium, which has an insulating layer formed on a cylindrical conductive layer. Voltage is applied between the photosensitive member and the conductive layer of the electrostatic information recording medium drum. Electric charge is accumulated in the shape of an image on the surface of the electrostatic information recording medium drum, by performing image exposure from the direction of the photosensitive member. Recording film is supplied at the same speed as the rotating speed of the drum on contact or non-contact basis with the drum, and toner development is performed by a developing machine which is installed face to face to the drum with the recording film therebetween. A conductive roller may be provided at a position where the recording medium is separated from the drum.

6 Claims, 3 Drawing Sheets

(c)

ELECTROSTATIC PRINTING METHOD

BACKGROUND OF THE INVENTION

The present invention relates to an electrostatic printing method, by which electrostatic latent image is formed on the electrostatic information recording medium on a drum and the electrostatic printing is performed, using said drum as original plate.

Conventionally, high resolution photographing technique has been practiced, utilizing silver halide graphic method, electronic photographic technique, television technique, solid state image sensor (such as CCD), etc. However, these methods are disadvantageous in that, when image recording is of high quality and high resolution, the treatment process is more complicated, and when the process is simple, the memory function is lacking or the image quality is basically inferior.

The present applicant has already proposed a method to form electrostatic latent image on electrostatic information recording medium by exposure under voltage application (Japanese Patent Application No. 63-121592), by which it is possible to record the image with high quality and at high resolution for long time through simple process and to repeatedly record and reproduce the memorized characters, line drawings, images and code (1,0) information as desired with the image quality suitable for each purpose.

When printing is performed using an electrostatic latent image with very high resolution as original plate, latent image is directly turned to visible image by toner and it is transferred. Because toner particles are attached on original plate and these are then detached and this procedure is repeated in this process, the original image is often damaged and it is difficult to accomplish perfect printing.

SUMMARY OF THE INVENTION

To eliminate such problems, the object of present invention is to offer an electrostatic printing method, by which it is possible to use the drum with electrostatic latent image on it as the original plate and to repeatedly print without damaging or disturbing the electrostatic latent image.

To attain such object, the present invention is characterized in that a photosensitive member having a photoconductive layer formed on a support member with a conductive layer therebetween is placed face-to-face to a drum of the electrostatic information recording medium having insulating layer on cylindrical conductive layer, that voltage is applied between the photosensitive member and the conductive layer of the electrostatic information recording medium drum and electric charge is accumulated in the form of the image on the surface of electrostatic information recording medium drum by image exposure from the direction of the photo-sensitive member, that recording film, is supplied at the same speed as the rotating speed of the drum on contact or non-contact basis with said drum, that toner development is performed by a developing machine installed face-to-face to the drum with the recording film therebetween, a conductive roller is provided at the position where film is separated from the drum in case of toner development on contact basis, that corona charging is performed on the surface of the drum consisting of a cylindrical electrode laminated with electric charge carrying medium layer and photosensitive member layer in this order, or with the photosensitive member layer and the electrostatic information recording medium layer in this order, and AC corona charge is performed or the conductive liquid is brought into contact after image exposure, that blanket exposure is performed after surface potential is earthed, and that toner development is performed by a developing machine, installed on the opposite side of the drum with the film therebetween, which is supplied at the same speed as the drum on contact or non-contact basis with said drum.

DESCRIPTION OF PREFERRED EMBODIMENTS

In the following, the features of the invention will be described on the preferred embodiments in connection with the drawings.

Figure 1:
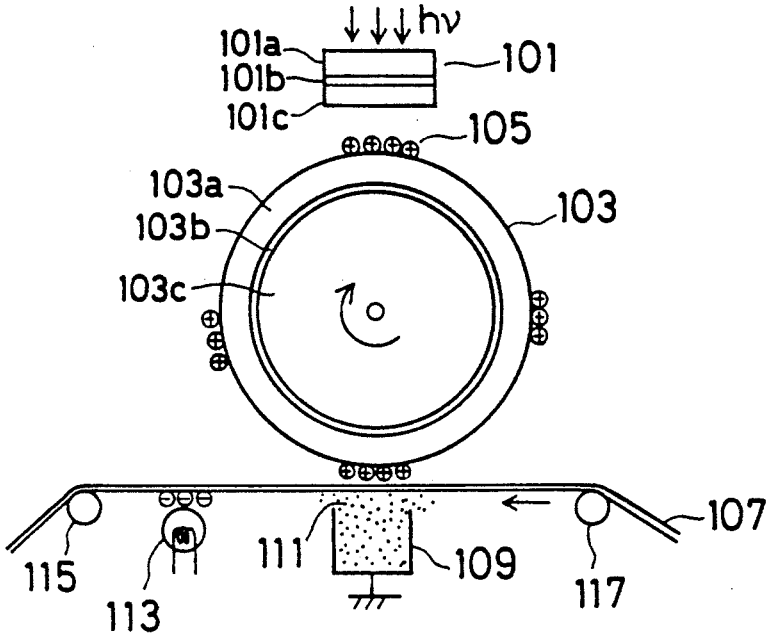
FIG. 1 shows an embodiment of the electrostatic printing method by this invention.

FIG. 1 shows an embodiment of the electrostatic printing method according to this invention which is characterized in that it utilizes a surface electric charge type electrostatic information recording medium. In the figure, 101 is a photosensitive member, 101*a* a support member, 101*b* an electrode, 101*c* a photoconductive layer, 103 a recording drum, 103*a* an insulating layer, 103*b* a cylindrical electrode, 103*c* a roller, 105 an electrostatic latent image, 107 a recording medium on film, 109 a developing machine, 111 a toner, 113 a fixation apparatus, and 115 and 117 supply rollers.

In this figure, the recording drum 103 is rotated at the predetermined speed, and the photosensitive member 101 is arranged face-to-face to this with a gap of about 10 μm. The recording film 107 is supplied at the same speed as the drum rotating speed on contact or non-contact basis with the drum 103. On the opposite side of the drum, a developing machine 109 is disposed with the toner 111 filled in it, and the developing machine itself is earthed.

When the image is exposed to the light from the direction of the photosensitive member 101 in the above arrangement, electrostatic latent image 105 is formed on the surface of the recording drum 103. Toner development is performed by the accumulated electric charge of electrostatic latent image 105 and by the toner 111 with reverse polarity from the developing machine 109, which is positioned on the opposite side of the recording drum with the recording film therebetween. If the recording film 107 does not allow moisture to pass through it in this case, the developing agent does not ooze out on the recording drum through film even when developing solution is used. Thus, electrostatic latent image is not disturbed. In case dry toner is used, the recording film may be ordinary paper, or liquid developer may be used if it is the paper, into which liquid does not permeate.

Thus, the accumulated electric charge and the toner with reverse polarity are attached on the film by electric suction force. In this case, if liquid developer is used, toner is attached on the film even when film is separated from the recording drum due to the dispersing solvent and there is no electric suction force any more, and it is possible to fix by the fixation apparatus and to print without disturbing the electrostatic latent image. In case dry toner is used, toner does not drop from film even when drum is placed at upper position and film is separated from drum, and the printing can be carried out in the same manner. (In the figure, developing machine is at the lower position.) Accordingly, it is possible by this invention to improve the printing resistance property.

Figure 2:
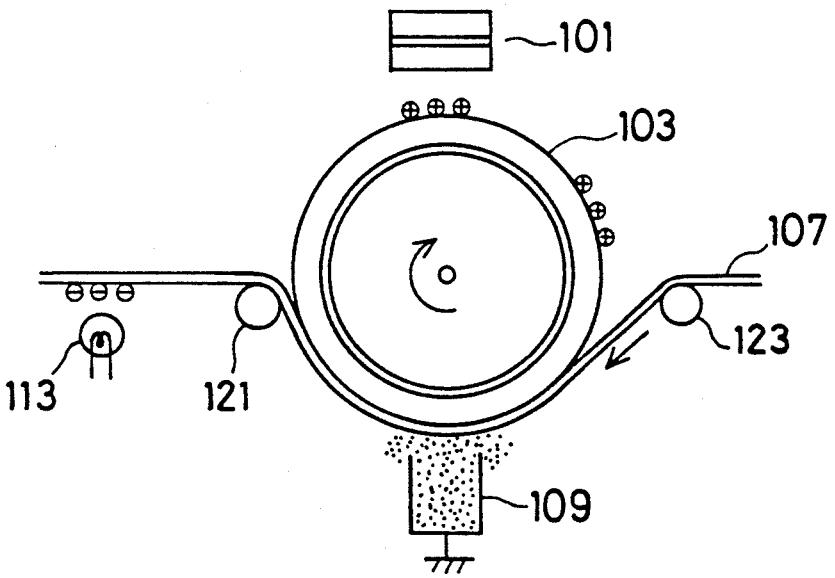
FIG. 2 and FIG. 3 show another embodiment according to this invention.

FIG. 2 shows another embodiment of this invention, and the same number represents the same component as in FIG. 1. In the FIG. 121 refers to a conductive roller, and 123 a roll.

This embodiment is characterized in that the recording film 107 is brought into contact with the recording drum 103, and that a conductive roller 121 is provided at the position where the recording film is separated from the drum after toner development. Namely, because separation charging occurs when the recording film 107 is separated from the drum and because the electrostatic latent image on the drum may be disturbed or film may be damaged due to discharge, the electric charge thus generated is leaked through the conductive roller 121.

By pressing the film on the drum by the roller 121, pressure fixation may be achieved. The fixation potency of the toner on the recording film can be increased, first by performing provisional fixation and through main fixation by the fixation apparatus thereafter.

Figure 3:
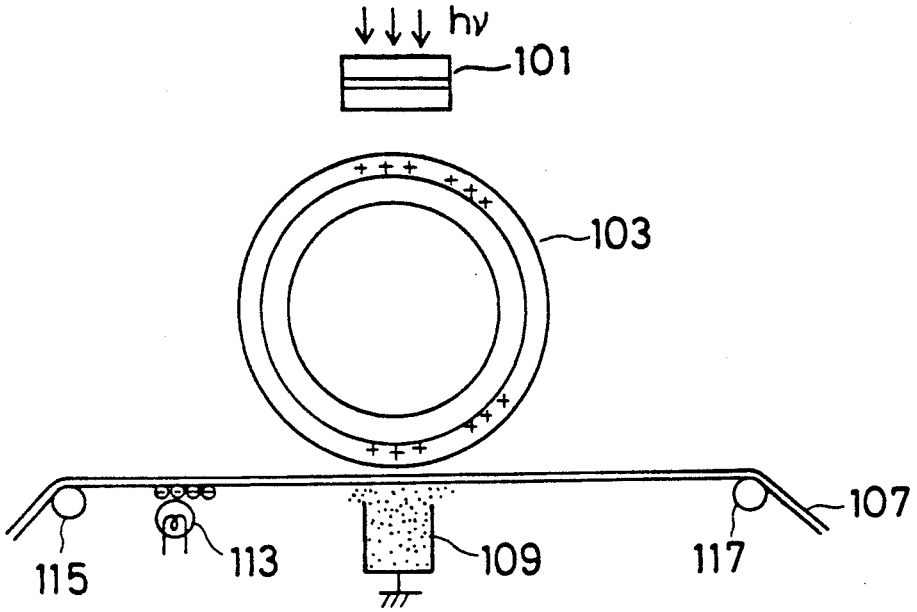

FIG. 3 represents still another embodiment of this invention, where the same number refers to the same component as in FIG. 1.

This embodiment is characterized in that an internal electric charge type electrostatic information recording medium is used as the recording drum 103. With voltage applied between the photosensitive member 101 and the recording drum 103, image exposure is carried out through the photosensitive member, and electric charge is accumulated on the recording drum 103. By the blanket exposure thereafter, a pair of hole and electron is generated inside. The accumulated electric charge on the surface generated by the image exposure is cancelled by the carrier with reverse polarity, and either the electric charge of the same polarity is formed inside, or the electric charge generated on the surface is accumulated inside. Therefore, there is no electric charge on the surface in this case, and electrostatic latent image is not disturbed when the film 107 is brought into contact with the recording drum 103.

To accumulate electric charge inside, there is a method, for example, to form the particle layer within the insulating layer.

The fine particles to accommodate electric charge are made of the photoconductive material and the electrically conductive material.

As the photoconductive materials for particles, inorganic photoconductive materials such as amorphous silicon, crystal silicon, amorphous selenium, crystal selenium, cadmium sulfide, zinc oxide, etc. may be used, or organic photoconductive materials such as polyvinylcarbazole, phthalocyanine, azo pigment, etc. may be used.

As the electrically conductive materials, IA group of the periodic table (alkali metals), IB group (copper group), II A group (alkali earth metals), II B group (zinc group), III A group (aluminum group), III B group (rare earth group), IV B group (titanium group), V B group (vanadium group), VI B group (chromium group), VII B group (manganese group), VIII (iron group and platinum group), or carbon, silicon, germanium tin and lead as IV A group (carbon group), and antimony and bismuth as V A group (nitrogen group), and sulfur, selnium and tellurium as VI A group (oxygen group) are used in fine powder. Of the elements described above, metals may be used as metallic ion, alloy in fine powder, organic metal or as complex. Also the above elements may be used in the form of oxide, phosphate, sulfate or halogenated compound. Above all, carbon, gold, copper, aluminum, tellurium, etc. are preferably used.

Next, description will be given on the method to form the particle layer.

First, the particle layer laminated in single layer or in multiple layers near the surface of resin layer can be formed by vacuum deposition of the material for particle layer on the resin layer, which is laminated on the support member in an unhardened, molten or softened state, using low vacuum evaporation equipment. When the material for particle layer is evaporated under low vacuum condition of $10-10^{-3}$ Torr, it is aggregated and is turned to superfine particles of 10–0.1 $\mu$m in diameter. When the resin layer is softened by heating during vacuum evaporation, the particles are laminated in well-aligned state in single layer or in multiple layers immediately inside the surface of the resin layer. In case the resin layer is of thermoplastic resin, it is softened by resistance heating or the substrate is directly heated by heater. In case the resin layer is of thermosetting resin, ultraviolet-setting resin, or electron beam setting resin, the material for particles is vacuum-deposited in the unhardened state and is hardened by an adequate hardening means after the particle layer is formed.

There is another method to form particle layer immediately inside the surface of the resin layer. In this case, the particle layer is vacuum deposited in single layer or multiple layers in the same manner on the support member, in which said resin layer is formed and hardened on the electrode plate. In this case, particle layer is formed on the surface of resin layer. Then, the same resin as used to form said resin layer or different insulating resin are laminated within the range of 0.1–30 $\mu$m. As the laminating method, there are the dry method to directly form the resin layer by vacuum evaporation, sputtering, etc. and the wet method to use the solution with the resin dissolved by solvent and to dry up the solvent after forming the film by spin coating, dipping, blade coating, etc. To obtain uniform particle size on the particle layer, the substrate may be heated up to the temperature not to melt the resin layer.

Figure 4:
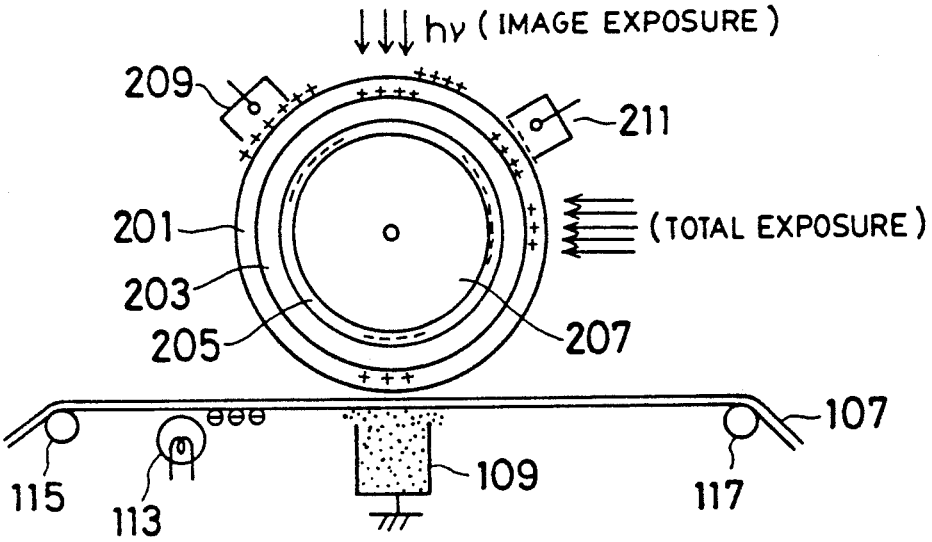
FIG. 4 represents still another embodiment of this invention, where the photosensitive member and the electrostatic information recording medium are integrated with each other.
Figure 5:
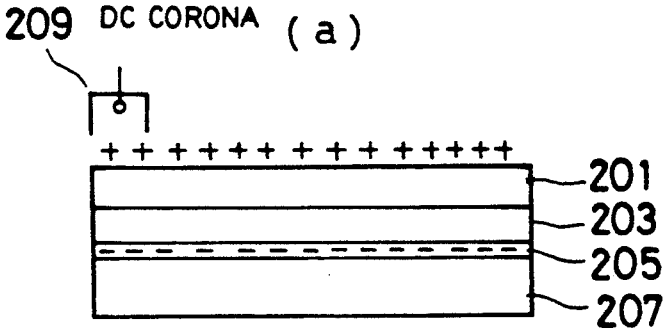
FIGS. 5(*a*)–5(*d*) is a drawing to explain the printing method of FIG. 4.
Figure 5B:
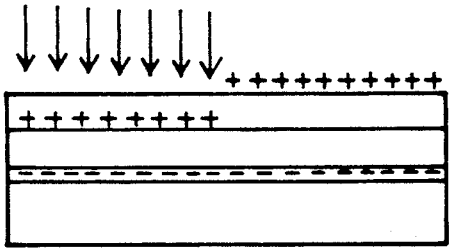
Figure 5:
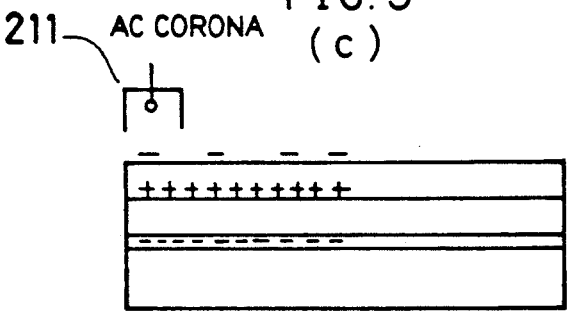
Figure 5D:
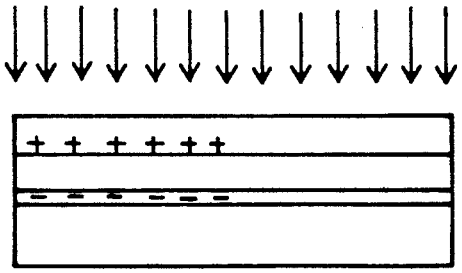

FIG. 4 shows another embodiment of this invention, and FIG. 5 is a drawing to explain the principle of the electrostatic latent image formation in FIG. 4. In these figures, the same number refers to the same component as in FIG. 1, and 201 is a photosensitive member, 203 an insulating layer, 205 a cylindrical electrode, 207 a roller, 209 a DC corona charger, and 211 AC corona charger.

First, the formation of electrostatic latent image in FIG. 5 is described. Overall corona charging is performed on the surface of the photosensitive member 201 by DC corona charger 209 (FIG. 5(*a*)). Next, when image exposure is performed as shown in FIG. 5(*b*), carrier is generated inside the photosensitive member 201. Negative electric charge is neutralized by the positive electric charge, and only the positive electric charge is accumulated in the insulating layer 203.

By the corona charge on the entire surface by AC corona charger 211, surface electric charge is neutralized (FIG. 5(*c*)). Or, instead of neutralization by AC corona, surface potential may be earthed by pouring the conductive liquid or solvent on the surface.

In so doing, all surface electric charges are eliminated on the portion where electric charge is not accumulated on the insulating layer 203. On the other hand, on the portion where electric charge is accumulated on the insulating layer, negative electric charge is generated on the surface by the influence of electric field due to the accumulated electric charge. Under this condition, the electric charge in the insulating layer does not give influence outside the layer, and the electrostatic latent image cannot be detected.

When total exposure is performed as shown in FIG. 5(*d*), carrier is generated on the portion where electric charge is accumulated inside because electric field is generated on the photosensitive member. By this carrier, negative electric charge on the surface is cancelled, and positive electric charge of the same quantity accumulated inside is cancelled at the same time. As the result, the influence of the electric charge accumulated inside appears when seen from outside, and it is detected as an electrostatic latent image.

Based on this principle, corona charge is generated on the photosensitive member 201 by DC corona charger 209 in FIG. 4. Then, image exposure is performed, and electric charge is accumulated on the insulating layer 203. Next, the surface electric charge is neutralized by AC corona charger 211, and the electrostatic latent image is formed on the insulating layer by total exposure thereafter. By performing toner development by the developing machine 109 as in the case of FIG. 3, printing can be accomplished repeatedly without disturbing the electrostatic latent image at all.

In the embodiment of FIG. 4, photosensitive member is formed on the insulating layer. It is also possible to form electrostatic latent image by the same principle and to perform printing when photosensitive member is formed on the cylindrical electrode at first and the insulating layer is then formed on it. However, the electrostatic latent image is formed on the surface of the insulating layer in this case.

As described above, it is possible by the present invention to form a drum by electrostatic information recording medium or by combining electrostatic information recording medium with photosensitive member, to form electrostatic latent image on the surface or inside said drum and to perform printing repeatedly without disturbing electrostatic latent image using the drum as original plate. This extensively improves the printing resistance property of the original plate. Also, it is possible to integrate photosensitive member and electrostatic information recording medium and to perform printing without requiring the photosensitive member.

What we claim is:

1. An electrostatic printing method, wherein a photosensitive member having photoconductive layer formed on a support member with a conductive layer therebetween is placed face-to-face with a drum of electrostatic information recording medium comprising an insulating layer formed on a cylindrical conductive layer, that voltage is applied between the photosensitive member and the conductive layer of the electrostatic information recording medium drum and electric charge is accumulated in the shape of an image on the surface of the electrostatic information recording medium drum by performing image exposure from the direction of the photosensitive member, that recording film is supplied at the same speed as the rotating speed of the drum on contact or non-contact basis with said drum, and that toner development is performed by a developing machine, which is installed face-to-face to the drum with the recording film therebetween.

2. An electrostatic printing method as recited in claim 1, wherein said recording film comprises paper.

3. An electrostatic printing method, wherein a photosensitive member having photoconductive layer formed on a support member with a conductive layer therebetween is placed face-to-face with a drum of electrostatic information recording medium comprising an insulating layer formed on a cylindrical conductive layer, that voltage is applied between the photosensitive member and the conductive layer of the electrostatic information recording medium drum and electric charge is accumulated in the shape of an image on the surface of the electrostatic information recording medium drum by performing image exposure from the direction of the photosensitive member, that recording film is supplied at the same speed as the drum by bringing the recording film into contact with said drum, that toner development is performed by a developing machine, installed at the position face-to-face to the drum with the recording film therebetween, and that a conductive roller is provided at the position where the recording film is separated from the drum.

4. An electrostatic printing method as recited in claim 3, wherein said recording film comprises paper.

5. An electrostatic printing method as set forth in claim 1 or 2, wherein said drum consists of a surface electric charge type electrostatic information recording medium.

6. An electrostatic printing method as set forth in claim 1 or 2, wherein said drum consists of an internal electric charge type electrostatic information recording medium.

* * * * *